US009274449B2

(12) United States Patent
Takahashi

(10) Patent No.: US 9,274,449 B2
(45) Date of Patent: Mar. 1, 2016

(54) IMAGE FORMING APPARATUS AND METHOD FOR FORMING AN IMAGE WITH MULTIPLE TONERS HAVING DIFFERENT BRIGHTNESS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Koji Takahashi, Tokyo (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/225,309

(22) Filed: Mar. 25, 2014

(65) Prior Publication Data

US 2015/0277260 A1 Oct. 1, 2015

(51) Int. Cl.
*G03G 15/01* (2006.01)

(52) U.S. Cl.
CPC ..... *G03G 15/0131* (2013.01); *G03G 15/0189* (2013.01); *G03G 2215/0122* (2013.01)

(58) Field of Classification Search
CPC ..... G03G 15/0131; G03G 15/0189; G03G 15/1605; G03G 2215/0122; G03G 2215/0125; G03G 2215/0129
USPC ..... 399/40, 223, 228, 231, 299, 302
See application file for complete search history.

(56) References Cited

U.S. PATENT DOCUMENTS

| | | | | |
|---|---|---|---|---|
| 6,516,175 | B2 | 2/2003 | Ogasawara | |
| 2009/0087767 | A1 * | 4/2009 | Nakamura | 430/108.2 |
| 2013/0164008 | A1 * | 6/2013 | Shimmura et al. | 399/53 |
| 2014/0255056 | A1 * | 9/2014 | Katayama | 399/85 |

FOREIGN PATENT DOCUMENTS

JP 2011107490 A * 6/2011

* cited by examiner

*Primary Examiner* — Robert Beatty
(74) *Attorney, Agent, or Firm* — Patterson & Sheridan, LLP

(57) ABSTRACT

An image forming apparatus includes a first image forming unit configured to form a first image to be transferred to a sheet with a first toner that is decolorizable and has a first brightness, and a second image forming unit configured to form a second image to be transferred to the sheet with a second toner that has a second brightness that is greater than the first brightness. At least a part of the first image transferred to the sheet is formed above the second image transferred to the sheet.

20 Claims, 7 Drawing Sheets

| | | | | | | | |
|---|---|---|---|---|---|---|---|
| ORDINARY TONER Bk | IMAGE DENSITY | 0.3 | 0.57 | 0.75 | 0.93 | 1.09 | 1.41 |
| | WEIGHT ON SHEET(mg) | | 50.2 | 74.5 | 108.6 | | |
| | TONER AMOUNT (mg/cm2) | 0.02 | 0.115 | 0.170 | 0.248 | 0.300 | 0.4 |
| DECOLOR-IZABLE TONER Bk | IMAGE DENSITY | 0.3 | 0.45 | 0.6 | 0.75 | 1 | 1.21 |
| | TONER AMOUNT (mg/cm2) | 0.28 | 0.45 | 0.6 | 0.7 | 0.85 | 0.95 |

| | IMAGE DENSITY OF BLACK TONER | 0.3 | 0.5 | 0.75 | 1.31 | 1.57 |
|---|---|---|---|---|---|---|
| ORDINARY TONER Bk | TONER AMOUNT ON SHEET (mg/cm2) | 0.02 | 0.1 | 0.17 | 0.36 | 0.44 |
| DECOLOR-IZABLE TONER Bk | TONER AMOUNT ON SHEET (mg/cm2) | 0.28 | 0.48 | 0.6 | | |
| | FULL-COLOR IMAGE DENSITY (OVERLAP BLACK DECOLORIZABLE TONER ON Y, M, C ORDINARY TONERS) | 0.92 | 1.2 | 1.37 | 1.58 | 1.62 |

IMAGE FORMING APPARATUS AND METHOD FOR FORMING AN IMAGE WITH MULTIPLE TONERS HAVING DIFFERENT BRIGHTNESS

FIELD

Embodiments described herein relate to an image forming apparatus that forms an image with a decolorizable color material.

BACKGROUND

To preserve the environment, one type of an image forming apparatus prints an image on a sheet with a decolorizable color material. Such a decolorizable color material can be decolorized when heated to a certain temperature. Therefore, a sheet from which the image formed of the decolorizable color material has been erased can be reused. In some cases, for example, when forming a full-color image on a sheet, an image forming apparatus forms the image with plural layers of color materials, and some or all of the color materials may be decolorizable.

However, depending on the environmental conditions for the printing, a density of the printed image, the number of times the sheet has been reused, and the type of the sheet, a part of the printed image may be left after an erasing process. Especially, when the image is formed on a sheet with plural layers of color materials, as described above, and a layer of the decolorizable color material is formed underneath the other layers, the color of the decolorizable material may not be sufficiently decolorized. This is because the decolorizable color material does not reach the decolorizable temperature when the sheet is heated.

DETAILED DESCRIPTION

The image forming apparatus according to embodiments described herein forms a color image with layers of color materials, each having a unique color.

According to embodiments, an image forming apparatus includes a first image forming unit configured to form a first image to be transferred to a sheet with a first toner that is decolorizable and has a first brightness, and a second image forming unit configured to form a second image to be transferred to the sheet with a second toner that has a second brightness that is greater than the first brightness. At least a part of the first image transferred to the sheet is formed above the second image transferred to the sheet.

The image forming apparatus according to the embodiment is described below in detail with reference to accompanying drawings.

First Embodiment

Figure 1:
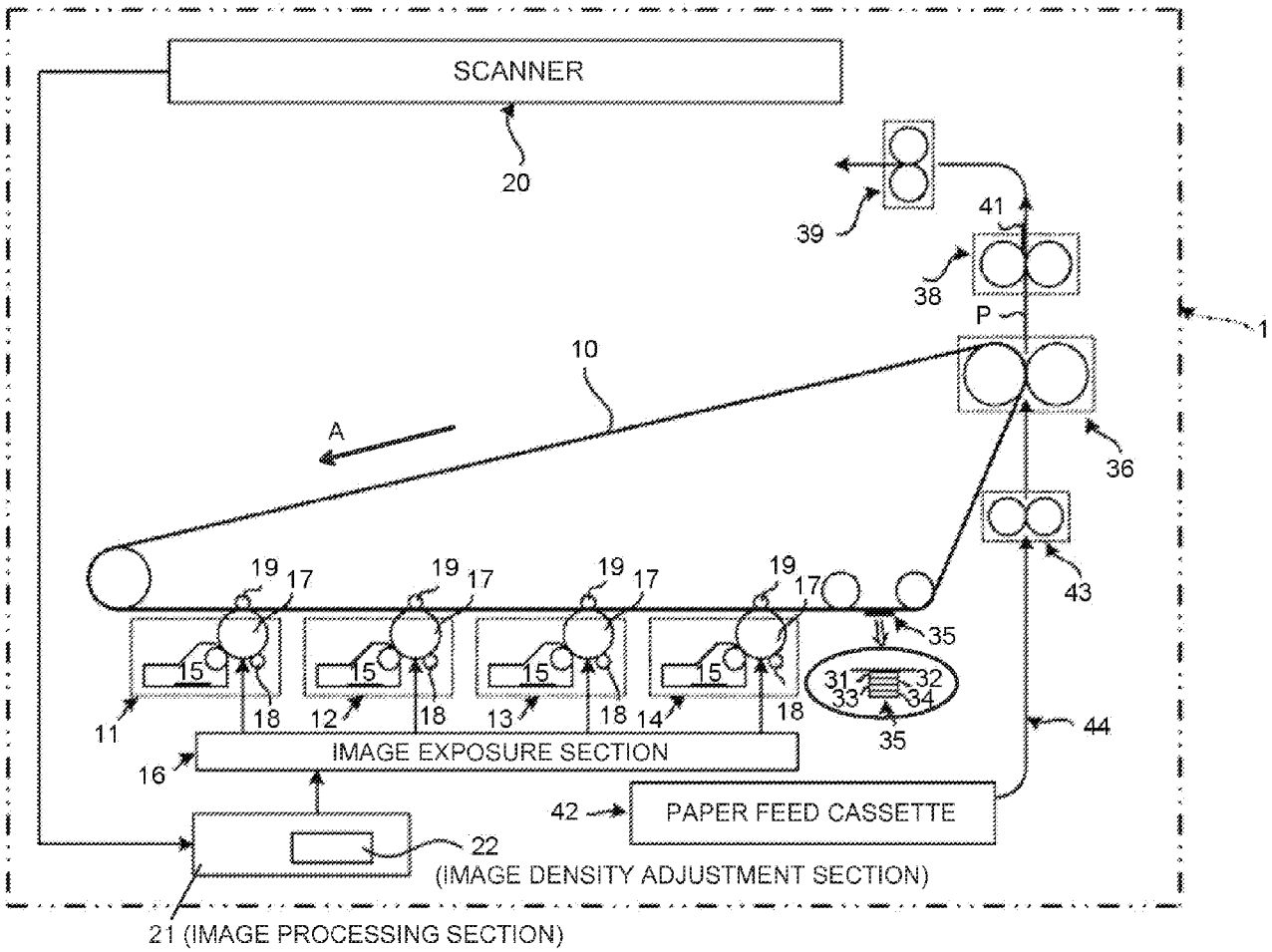
FIG. 1 is a diagram schematically illustrating a configuration of an image forming apparatus according to a first embodiment.

FIG. 1 is a diagram schematically illustrating a configuration of an image forming apparatus according to a first embodiment.

As shown in FIG. 1, an image forming apparatus 1 includes an endless secondary transfer belt 10 rotating in the direction indicated by an arrow A and a plurality of image forming stations 11, 12, 13, and 14, arranged from an upstream side to a downstream side of a rotation direction of the secondary transfer belt 10 to form color images.

In this embodiment, the first image forming station 11 to the fourth image forming station 14, each have the same structure. Each of the image forming stations includes a developer 15 for housing a decolorizable toner serving as a decolorizable color material, a photoconductive drum 17 for forming a latent image with the image exposure light emitted from an image exposure section 16, and a charger 18 for charging the photoconductive drum 17 uniformly.

Moreover, a primary transfer roller 19 is disposed opposite to each of the photoconductive drums 17 across a secondary transfer belt 10. For example, when copying an image scanned by a scanner 20, RGB image signals generated by the scanner 20 are converted to color signals, each corresponding to the first to the fourth image forming stations 11-14 in an image processing section 21. Then, an exposure light source of the image exposure section 16 is controlled to irradiate corresponding photoconductive drums 17 based on the generated color signal in order to form a latent image on each of the photoconductive drums 17.

The latent image formed on each of the photoconductive drums 17 is developed into a toner image with a decolorizable toner of a corresponding color by the developer 15.

Here, a first toner image 31 of a first color is primarily transferred on the secondary transfer belt 10 from the photoconductive drum 17 of the first image forming station 11. Next, a second toner image 32 of a second color formed on the photoconductive drum 17 of the second image forming station 12 is transferred on the first toner image 31 formed on the secondary transfer belt 10. Similarly, a third toner image 33 of a third color is disposed on the second toner image 32 at the third image forming station 13, and a fourth toner image 34 of a fourth color is disposed on the third toner image 33 at the fourth image forming station 14.

In this embodiment, image density of the first toner image 31, the second toner image 32, the third toner image 33, and the fourth toner image 34 can be set to be the same or be adjusted individually. An image density adjustment section 22 for adjusting an image density may be provided, for example, in the image processing section 21, to adjust an image density by, for example, adjusting the exposure intensity (luminance) of the image exposure light emitted from the image exposure section 16 onto the photoconductive drum 17. Additionally, the image density may also be adjusted by adjusting the charge quantity of the photoconductive drum 17, and therefore a method to adjust the image density is not limited to be adjusted by adjusting the exposure intensity.

Unfixed toner images 35 formed of four layered toner images are secondarily transferred onto a sheet by a secondary transfer roller 36. The unfixed toner images 35 secondarily transferred onto the sheet P has a structure that the third toner image 33, the second toner image 32, and the first toner image 31 are orderly laminated on the fourth toner image 34 on the sheet P.

The unfixed toner images 35 secondarily transferred on the sheet P are heated and pressed by a fixer 38 to be fixed on the sheet P. Then, the sheet is discharged to a sheet discharging section (not shown) by a sheet discharging roller 39. Here, the fixed toner image 41, as shown in FIG. 2, is fixed in a state in which the laminated structure of the first toner image 31 to the fourth toner image 34 is substantially maintained.

In this embodiment, a black toner is held in the developer 15 of the first image forming station 11, and the black toner image 31 formed of the black toner is primarily transferred onto the secondary transfer belt 10. A cyan toner is held in the developer 15 of the second image forming station 12, and the cyan toner image 32 of the cyan toner is laminated on the black toner image 31. Further, a magenta toner is held in the developer 15 of the third image forming station 13, and the magenta toner image 33 of the magenta toner is laminated on the cyan toner image 32. A yellow toner is held in the developer 15 of the fourth image forming station 14, and the yellow toner image 34 of the yellow toner is laminated on the magenta toner image 33.

The sheet P is conveyed along a sheet conveyance path 44 extending from a paper feed cassette 42 to the sheet discharging roller 39 through a register roller 43, a secondary transfer position 37 and a fixer 38.

Figure 2:
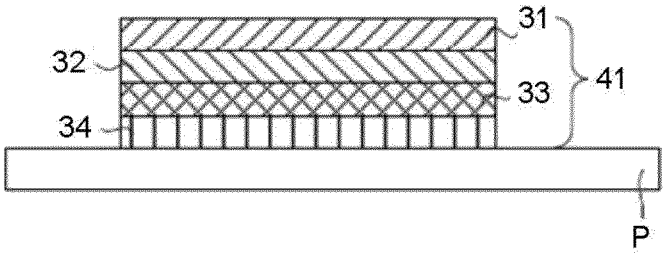
FIG. 2 is a diagram illustrating an example of a layered structure of color materials formed on a sheet by the image forming apparatus according to the first embodiment.

The yellow toner image 34, which has the highest brightness, the magenta toner image 33, the cyan toner image 32, and the black toner image 31, which has the lowest brightness, are transferred on the sheet P at the secondary transfer position, as shown in FIG. 2.

The decolorizable color material is described below.

The decolorizable toner used in the embodiment contains a binder resin, an electron donating coloring agent, and an electron accepting color developing agent. A decolorizing agent may also be added in the decolorizable toner. Further, particles of the electron donating coloring agent, the electron accepting color developing agent, and the decolorizing agent may be encapsulated in capsules and formed as encapsulated color material particles, which are contained in the decolorizable toner.

(Electron Donating Coloring Agent)

The electron donating coloring agent mainly refers to leuco dye, which is an electron donating compound that can develop a color when combined with a color developing agent. The electron donating compound is, for example, diphenylmethanephthalides, phenylindolylphthalides, indolylphthalides, diphenylmethaneazaphthalides, phenylindolylazaphthalides, fluorans, styryl quinolines, diazarhodaminelactones, and the like.

(Electron Accepting Color Developing Agent)

The color developing agent is an electron-accepting compound which provides the electron donating coloring agent with protons. The electron-accepting compound is, for example, phenols, metal salts of phenol, metal salts of carvone acid, aromatic carboxylic acid and aliphatic acids having 2-5 carbons, benzophenones, sulfone acid, sulphonate, phosphoric acids, metal salts of phosphoric acid, alkyl acid phosphate, metal salts of acid phosphate, phosphorous acids, metal salts of phosphorous acid, monophenols, polyphenols, 1,2,3-triazole, and derivatives thereof.

(Decolorizing Mechanism)

The coloring agent of leuco dyes such as CVL (crystal violet lactone) has a characteristic that it develops a color when combined with a color developing agent and is decolorized when dissociated from the color developing agent. In addition to the coloring agent and the color developing agent, a temperature controlling agent that has a large difference between its melting point and a solidifying point may be used. When the temperature controlling agent that has a solidifying point lower than a normal temperature is used, the color of toner is decolorized when heated above the melting point and the decolorized state can be maintained at the normal temperature. In embodiments described herein, for example, a color material that can develop a color and decolorized may be formed byencapsulating a leuco coloring agent, a color developing agent, and a temperature controlling agent.

Methods for producing particles of each color material particles and the toner are described below.

(Production of Yellow Color Developing Particles)

Hereinafter, "parts" refer to "parts by weight" and "%" refers to "% by weight."

A solution obtained by uniformly heat-dissolving a composition containing 3.0 parts of 4-[2,6-bis(2-ethoxyphenyl)-4-pyridinyl]-N,N-dimethylbenzenamine, 10.0 parts of 2,2-bis(4'-hydroxyphenyl)hexafluoropropane, and 50 parts of a diester compound of pimelic acid with 2-(4-benzyloxyphenyl)ethanol as a decolorizing agent, and adding 20 parts of an aromatic polyvalent isocyanate prepolymer and 40 parts of ethyl acetate thereto as encapsulating agents was added to 300 parts of an aqueous solution of 8% polyvinyl alcohol and emulsified and dispersed therein.

The mixture obtained is continuously stirred for about 1 hour at 90 degrees centigrade and then 2.5 parts of water-soluble aliphatic modified amine serving as a reactant is added therein. Then, the mixture obtained is continuously stirred for 6 hours, and leuco capsule particles dispersed in the stirred solution are obtained. Further, the capsule particle dispersion is placed in a freezer to develop color, and thereby yellow color developing particle dispersion is obtained. When measured by the SALD7000 produced by SHIMADZU Corporation, the yellow color developing particle has a volume average particle diameter of 3 μm. Further, a fully-decolorizing temperature Th of the yellow color developing particle is 62 degrees centigrade and a fully-coloring temperature Tc of the yellow color developing particle is −14 degrees centigrade.

(Production of Magenta Color Developing Particles)

A solution obtained by uniformly heat-dissolving a composition containing 1.0 part of 1,2-benz-6-(N-ethyl-N-isoamylamino)fluoran, 2.0 parts of 1,3-dimethyl-6-diethylaminofluoran, 4.5 parts of 4,4'-(2-methylpropylidene) bisphenol, 7.5 parts of 2,2-bis(4'-hydroxyphenyl) hexafluoropropane, and 50 parts of a diester compound of pimelic acid with 2-(4-benzyloxyphenyl)ethanol as a decolorizing agent, and adding 30 parts of an aromatic polyvalent isocyanate prepolymer and 40 parts of ethyl acetate thereto as encapsulating agents was added to 300 parts of an aqueous solution of 8% polyvinyl alcohol and emulsified and dispersed therein.

Then, the mixture obtained is continuously stirred for about 1 hour at 90 degrees centigrade and then 2.5 parts of water-soluble aliphatic modified amine serving as a reactant is added therein. Then, the mixture obtained is continuously stirred for 6 hours, and leuco capsule particles dispersed in the stirred solution are obtained. Further, the capsule particle dispersion is placed in a freezer to develop color, and thereby magenta color developing particle dispersion is obtained. When measured by the SALD7000, the magenta color developing particle has a volume average particle diameter of 3 um. Further, the fully-decolorizing temperature Th of the magenta color developing particle is 62 degrees centigrade, and the fully-coloring temperature Tc of the magenta color developing particle is −14 degrees centigrade.

(Production of Cyan Color Developing Particles)

A solution obtained by uniformly heat-dissolving a composition containing 2.0 parts of 4,5,6,7-tetrachloro-3-[4-(dimethylamino)-2-methylphenyl]-3-(1-ethyl-2-methyl-1H-indol-3-yl)-1(3H)-isobenzofuranone, 3.0 parts of 4,4'-(2-ethylhexane-1,1-diyl)diphenol, 5.0 parts of 2,2-bis(4'-hydroxyphenyl)hexafluoropropane, and 50 parts of a diester compound of pimelic acid with 2-(4-benzyloxyphenyl)ethanol as a decolorizing agent, and adding 30 parts of an aromatic polyvalent isocyanate prepolymer and 40 parts of ethyl acetate thereto as encapsulating agents was added to 300 parts of an aqueous solution of 8% polyvinyl alcohol solution.

Then, the mixture obtained is continuously stirred for about 1 hour at 90 degrees centigrade and then 2.5 parts of water-soluble aliphatic modified amine serving as a reactant is added. Then the mixture obtained is continuously stirred for 6 hours, and leuco capsule particles disposed in the stirred solution are obtained. Further, the capsule particle dispersion is placed in a freezer to develop color, and thereby cyan color developing particle dispersion is obtained. When measured by the SALD7000, the magenta color developing particle has a volume average particle diameter of 3 um. Further, the fully-decolorizing temperature Th of the magenta color developing particle is 62 degrees centigrade, and the fully-coloring temperature Tc of the magenta color developing particle is −14 degrees centigrade.

(Production of Black Color Developing Particles)

A solution obtained by uniformly heat-dissolving a composition containing 4.5 parts of 2-(2-chloroamino)-6-dibutylaminofluoran, 3.0 parts of 4,4'-(2-ethylhexane-1,1-diyl) diphenol, 5.0 parts of 2,2-Bis(4'-hydroxyphenyl)-hexafluoropropane, and 50 parts of caprylic acid-4-benzyl oxy phenyl ethyl serving as a decolorizing agent and adding 30 parts of an aromatic polyvalent isocyanate prepolymer and 40 parts of ethyl acetate thereto as encapsulating agents was added to 300 parts of an aqueous solution of 8% polyvinyl alcohol solution.

Then, the mixture obtained is continuously stirred for about 1 hour at 90 degrees centigrade and then 2.5 parts of water-soluble aliphatic modified amine serving as a reactant is added therein. Then, the mixture obtained is continuously stirred for 6 hours, and leuco capsule particles dispersed in the stirred solution are obtained. Further, the capsule particle dispersion is placed in a freezer to develop color, and then a black color developing particle dispersion is obtained. When measured by the SALD7000, the black color developing particle has a volume average particle diameter of 3 um. Further, the fully-decolorizing temperature Th of the black color developing particle is 62 degrees centigrade, and the fully-coloring temperature Tc of the black color developing particle is −14 degrees centigrade.

(Manufacturing Method of the Toner)

1.7 parts of color developing particle dispersion, 15 parts of toner composition particle R1 dispersion, and 83 parts of ion exchange water are mixed. The mixture is stirred using a homogenizer (produced by IKA) at 6500 rpm while 5 parts of 5% aluminum sulfate solution is added, and the obtained mixture is stirred at 800 rpm in a 1 L agitation tank provided with paddle blades while being heated to 40 degrees centigrade. The heated mixture is held for one hour at 40 degrees centigrade, and then 10 parts of 10% sodium polycarboxylate solution is added and the mixture is heated to 68 degrees centigrade. The obtained mixture is held for one hour and cooled, and thereby leuco toner dispersion is obtained.

Then, the toner dispersion is repeatedly filtered and cleaned with ion exchange water until the conductivity of the filtrate becomes 50 us/cm. Then, the filtrate is froze in a freezer of −20 degrees centigrade to cause the toner to develop color, then the filtrate is dried with a vacuum dryer until the water content of the filtrate is below 1.0% by weight, and then dried particles are obtained.

After the drying procedure, two parts by weight of hydrophobic silica and 0.5 parts by weight of oxidized titanium serving as an additive are adhered to surfaces of the toner particles, and thereby a decolorizable toner is obtained. When measured by a multisizer 3 produced by Coulter Corporation, the volume average particle diameter Dv of 50% is 10.5 um.

The toner obtained is mixed with a ferrite carrier coated with silicon resin to serve as an image developing agent.

Figure 4:
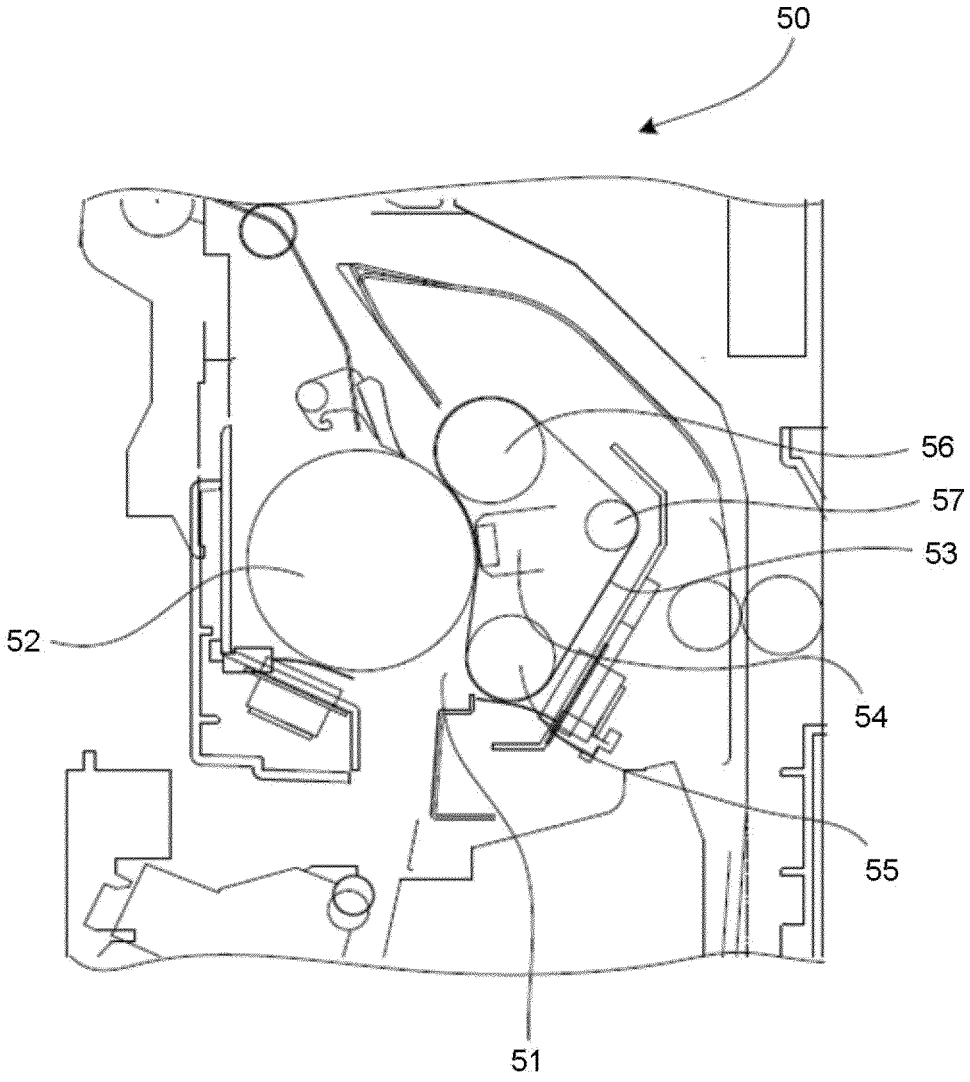
FIG. 4 is a cross sectional view of an erasing apparatus.

Next, when erasing a fixed color toner image 41 formed with the decolorizable toner using an erasing apparatus, for example, the sheet is fed to the nip section 51 of an erasing apparatus 50 shown in FIG. 4 such that the fixed toner image is erased. The erasing apparatus 50 has a heat roller 52 in which a heater (not shown) is disposed and an endless heat belt 53. The heat belt 53 is pressed onto a circumferential surface of the heat roller 52 by a press pad 54 at the nip section 51. The heat belt 53 is wound around a belt heating roller 55, a press roller 56, and a tension roller 57. The heater disposed in the heat roller 52 is powered on to heat the external peripheral surface of the heat roller 52 to a specific erasing temperature. Further, the belt heating roller 55 may be heated by a heater (not shown) to cause the heat belt 53 to be heated.

Figure 3:
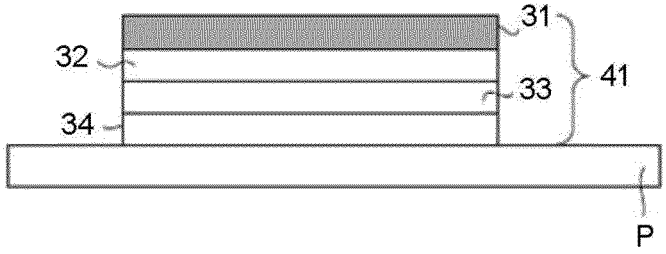
FIG. 3 is a diagram illustrating another example of a layered structure of color materials formed on a sheet by the image forming apparatus according to a second embodiment.

The fixed toner image 41 passing through the nip section 51 is erased as shown in FIG. 3. Here, as the first toner image 31 is set to be black, the second toner image 32 is set to be cyan, the third toner image 33 is set to be magenta, and the fourth toner image 34 is set to be yellow. The yellow toner image 34 closest to the sheet P has a highest brightest in the four colors, and the black toner image 31 has a lowest brightness.

On the other hand, as shown in FIG. 3, the toner image 41 is not completely erased after the erasing process, and a portion of the toner image is left. Usually, a toner layer that is closest to the sheet P is less likely to be decolorized. In this case, if the brightness of the toner layer closest to the sheet P is lower than those of the other toner layers, then the image part left after the erasing of the toner image is likely to be more recognizable. For example, if a black toner layer is closest to the sheet P, the residual image portion is recognizable.

However, in this embodiment, the toner layer having a lowest brightness is formed at the top position furthest from the surface of the sheet P, but not at the position closest to the surface of the sheet P. As a result, the residual image portion formed of the toner having the lowest brightness left after the erasing process is less recognizable. Further, as the toner layer having a highest brightness is formed at the position closest to the surface of the sheet P, more image portion formed of the toner having the highest brightness tends to be left after the erasing process. However, as the color of the toner having the highest brightness can be observed in a state blended with the white color of the sheet P, that image portion is unrecognizable.

Further, measured by the Chroma Meter CR-200 produced by Minolta Corporation, when the solid images are formed on the sheet P by the image forming apparatus 1 on a condition that the amounts of the toners of each color adhered on the sheet P are equal, the following result is obtained: the brightness of the solid images are: Yellow (Y): 88.05, Cyan (C): 51.15, Magenta (M): 46.92, and Black (BK): 25.11, according to an exemplary brightness (L*) measurement result based on the CIE color system L*/a*/b*.

Figure 5:
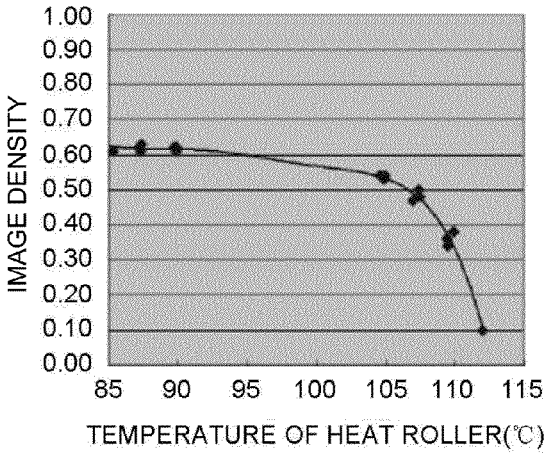
FIG. 5 is a diagram showing a relationship between the temperature of a heat roller in the erasing apparatus and an image density of a decolorizable toner.

FIG. 5 shows a relationship between the temperature of the heat roller 52 and an image density. According to FIG. 5, the color of the toner used in this experiment begins to be decolorized sharply from 105 degrees centigrade and is completely decolorized at about 112 degrees centigrade. Thus, the erasing temperature needed for the aforementioned erasing process refers to a temperature within a range Δt from a lower limit temperature at which the image is fully erased to an upper limit temperature at which the toner is not adhered to the heat roller 52 because of a high-temperature offset. According to this experiment, the range of the erasing temperature is from 112 degrees centigrade to 140 degrees centigrade; that is, Δt is 28 degrees centigrade.

Figure 6:
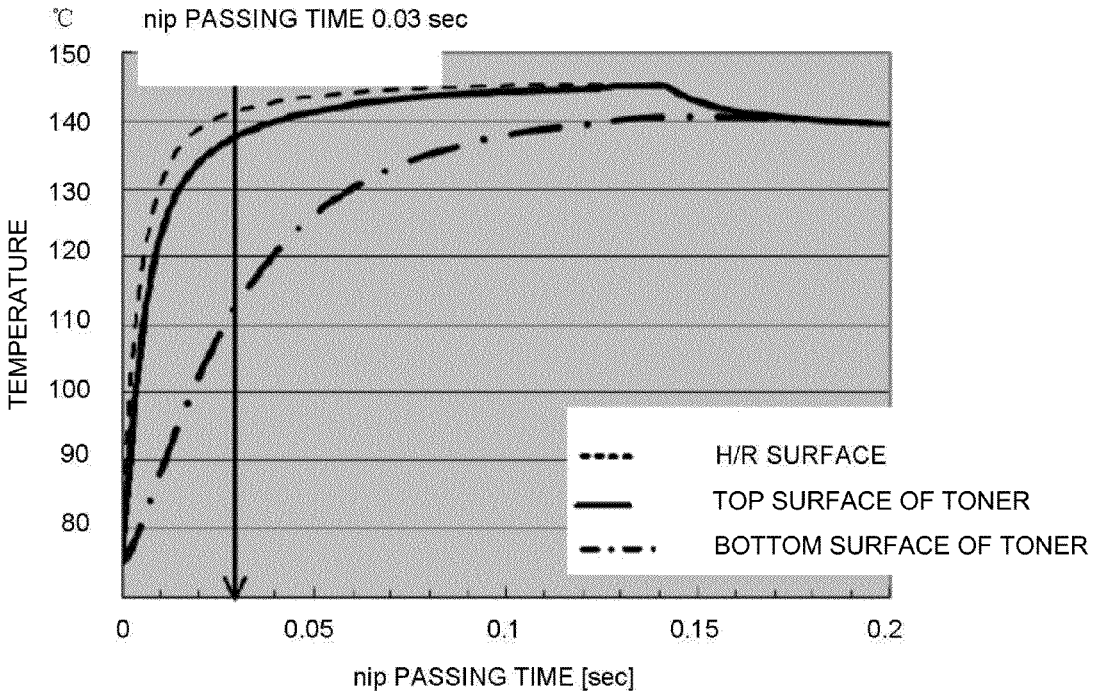
FIG. 6 is a diagram showing a relationship between a time period during which a sheet passes a nip section of the erasing apparatus and each of temperatures at a surface of a heat roller, a surface of an uppermost toner layer, a lowest toner layer.

FIG. 6 shows measured results of a temperature of the heat roller 52 and the toner on the sheet P with respect to a time period (NIP passing time) during which the object is located in a nip. The upper surface temperature of the toner layer (the first toner image 31) contacting the heat roller 52 is substantially equal to that of the heat roller 52 when the NIP passing time of the erasing apparatus 50 is set to 0.03 sec. Next, as the heat of the heat roller 52 needs to be conducted into the toner layer (toner image 41), the rise of the bottom surface temperature of the toner layer (the fourth toner image 34) contacting the surface of the sheet P is slow in comparison with that of the upper surface (the surface of the first toner image 31). As a result, the temperature of the bottom surface of the toner layers (the fourth toner image 34) is 26 degrees centigrade lower than that of the upper surface of the first toner image 31. Moreover, when the surface temperature error generated by temperature ripples caused by the lighting period of an ordinary heater, that is, a light heat source is considered, the temperature difference of plus or minus 3 degrees centigrade should be included. As a result, with respect to the top toner layer of the toner image 41, the temperature difference occurring at the bottom toner layer of the toner image 41 is about 29 degrees centigrade.

Depending on error factors such as environment and paper type are further considered, a color of the bottom toner layer may be left more significantly after the erasing process. In this case, if the color of the toner layer closest to the surface of the sheet P is black, which has a lowest brightness in a plurality of colors, then the residual image portion after the erasing process is likely to be more recognizable. With respect to this, as shown in FIG. 2 and FIG. 3, if a toner layer having a high brightness is formed in the bottom of the toner image 41, the residual image portion can be unrecognizable.

In order to form the toner layers according to the brightness with decolorizable toner, the developer 15 containing the toner having a highest brightness is arranged downstream with respect to the developer 15 containing the toner having a lowest brightness along the rotational direction of the secondary transfer belt 10 and located just upstream of the secondary transfer position to the sheet P serving as a recording medium. According to this arrangement of the developers 15, the order of the toner layers on the sheet can be determined, and the toner layer having a highest brightness can be formed at the bottom (in contact with the sheet). Consequently, even when a toner image portion is left after the erasing process, the residual image portion becomes unrecognizable, thus providing a good erasing quality for the next printing process.

Second Embodiment

The image forming apparatus according to a second embodiment has the same configuration as the image forming apparatus according to the first embodiment, and the developer of the first image forming station 11 contains a decolorizable black toner. However, developers 15 of the other image forming stations 12-14 contain non-decolorizable toners. The developer 15 of the second image forming station 12 contains cyan toner, the developer 15 of the third image forming station 13 contains magenta toner, and the developer 15 of the fourth image forming station 14 contains yellow toner.

If an erasing process is carried out for the fixed image 41 having such a toner layer structure, then only the color of the black toner image 31 formed on the top is decolorized and the other toner images remain. Thus, an image of the combined color of the other three colors is displayed.

Here, if the black toner image 31 is not fully erased through the erasing process, for example, a thin black residual image portion is left, then the quality of the image that should be displayed is degraded. In this embodiment, the toner layer on the top of the fixed image 41 is formed of the decolorizable toner. If the toner layer closest to the sheet P is a decolorizable toner layer, then the residual image portion left after the erasing process will be more recognizable.

If the density of toner images is set to be the same among the images fixed in the first image forming station, which forms a black toner image with a decolorizable black toner, and the images fixed in second image forming stations 12-14, which form cyan, magenta, and yellow toner images with non-decolorizable ordinary toners, then the amount of the decolorizable toner on the sheet should be much greater than those of the non-decolorizable ordinary toners. Thus more thermal conduction into the toner layers is needed for the erasing of the toner image.

In this embodiment, the density of the decolorizable toner image on the sheet is reduced to the extent that the quality of the image is not compromised. Thus, the residual image portion, if any, can be less recognizable.

A relationship between a toner adhesion amount and an image concentration is described below with reference to FIG. 7 to FIG. 11.

Figures 7, 8:
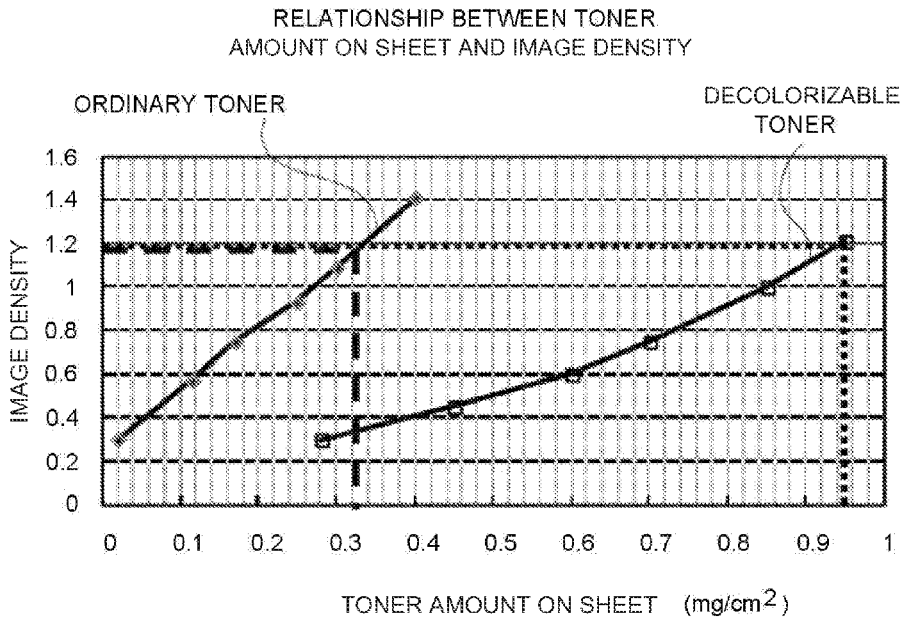
FIG. 7 is a chart showing a relationship between an amount of toner on a sheet and an image density of a non-decolorizable (ordinary) black toner and a decolorizable black toner according to a second embodiment.
FIG. 8 is a graph showing the relationship shown in FIG. 7.

In the chart shown in FIG. 7, a relationship between an image density and an amount of toner on a sheet is shown with respect to an ordinary toner serving as a non-decolorizable black (Bk) toner and a decolorizable black (Bk) toner. FIG. 8 is a graph showing the relationship shown in of FIG. 7, in which the longitudinal axis represents the image density, and the horizontal axis represents the amount of toner on a sheet. In FIG. 7 and FIG. 8, to obtain an image density of 1.21, the amount (mg/cm$^2$) of the ordinary toner needed is about 0.32, and that of the decolorizable toner needed is 0.95, which is about three times as much as that of the ordinary toner. The image concentration is measured by a Macbeth concentration meter RD-913 (Produced by Macbeth Corporation).

Further, the data shown in FIG. 7 and FIG. 8 is obtained under the following conditions: paper size: width*length (210 mm*297 mm); void: front end and rear end (6 mm, 54 mm); non-image region: left and right (4 mm, 1.5 mm); image region: width*length (150 mm*291.5 mm); area of image region (43725 $mm^2$), proper image density of ordinary toner and corresponding toner amount (1.41, 0.4 $mg/cm^2$); and proper image density of the decolorizable toner and corresponding toner amount (0.55, 0.58 $mg/cm^2$).

Figures 9, 10:
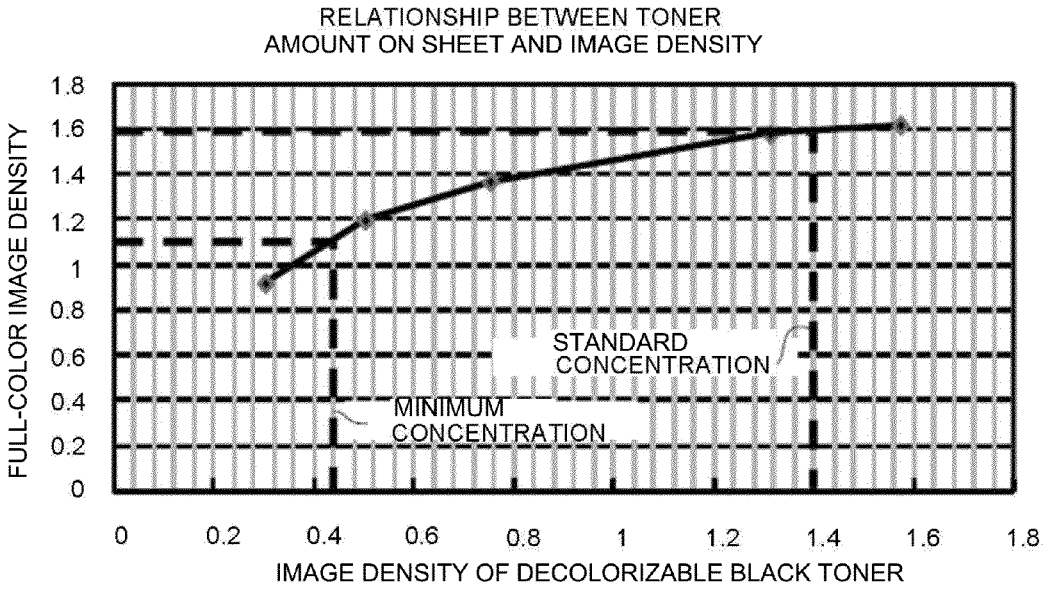
FIG. 9 is a chart showing a correlation among an image density of black toner, an amount of black toner on a sheet, and a full-color image density.
FIG. 10 is a graph showing the relationship between the full-color image density with respect to an image density of decolorizable black toner.

FIG. 9 is a chart showing necessary amount of a non-decolorizable (ordinary) black toner and the amount of decolorizable black toner to form the image with the image density of 0.3, 0.5, 0.75, 1.31 and 1.57. For example, necessary amount of a non-decolorizable (ordinary) black toner is 0.02 and necessary amount of a decolorizable toner is 0.28 to form the image with the image density 0.3.

The bottom line of the chart shows image density formed with the non-decolorizable toners of yellow, magenta, and cyan, and the decolorizable black toner overlapped on the yellow, magenta, and cyan toners. The amount of decolorizable black toner is 0.28, 0.48, and 0.6, respectively.

Figure 11:
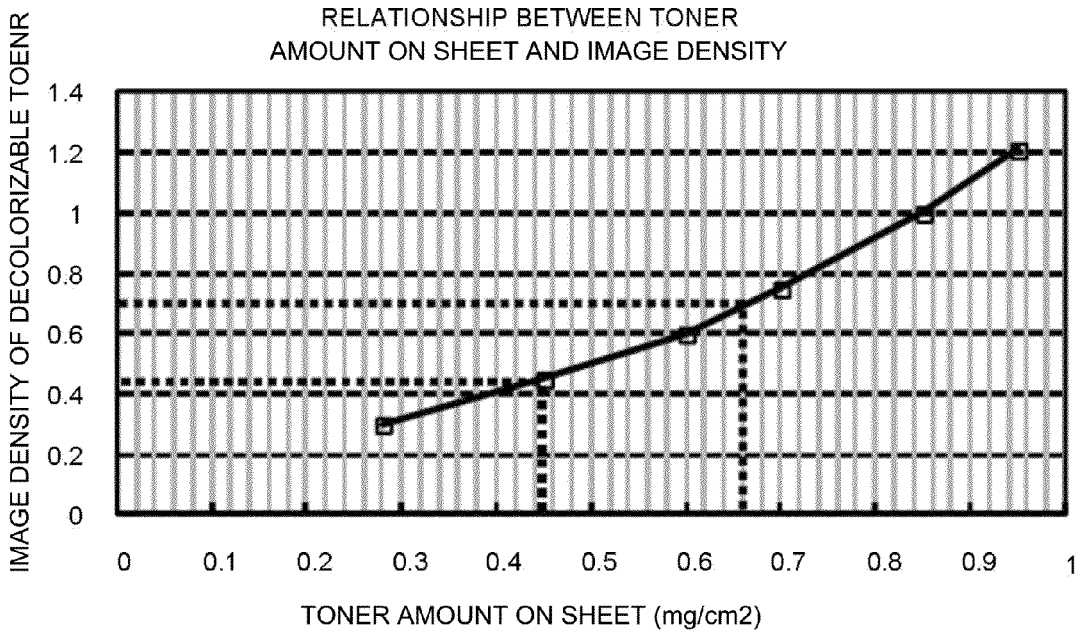
FIG. 11 is a graph illustrating the relationship between the amount of the decolorizable black toner on a sheet and the image density of the toner.

FIG. 10 is a graph showing the relationship between the image density of the decolorizable black toner and a full-color image density, shown in FIG. 9. FIG. 11 is a graph showing the relationship between the image density of the decolorizable black toner and the amount of the toner required on a sheet, shown in FIG. 9. Further, in FIG. 9, the full-color image density represents a total density of the decolorizable black (Bk) toner and the ordinary Yellow (Y), Magenta (M), and Cyan (C) toners.

In FIG. 10, the horizontal axis represents an image density of the decolorizable black toner, and the longitudinal axis represents a full-color image density with the decolorizable black toner. In a full-color image formed of overlapped toner layers, the full-color image density that is needed to obtain an inking effect (proper image density) is 1.1, and this value is set to be a minimum density. In this case, the image density of the decolorizable black toner is 0.44. Further, if the standard value of the full-color image density is set to be 1.62, then the image density of the decolorizable black toner is 1.4.

In FIG. 11, the horizontal axis represents the amount of decolorizable black toner on a sheet, and the longitudinal axis represents the image density of the decolorizable black toner. In FIG. 11, the amount of the decolorizable black toner needed on a sheet is 0.45 ($mg/cm^2$) when the minimum value of the image density of the decolorizable black toner is 0.44. Generally, the standard amount of toner on a sheet is 0.66 ($mg/cm^2$), and the image density corresponding to the standard toner adhesion amount can be found as 0.6 from FIG. 11. As there is no need to form toner on a sheet in an amount above the standard amount, the image density of the decolorizable black toner is preferably within a range from 0.44 to 0.6. More preferably, the image density is within a range from 0.44-0.5 in order to reduce the toner amount on a sheet and maintain the quality of an image.

That is, if the image density of the decolorizable black toner is higher than the minimum value of 0.44, the inking effect in a full-color image can be reliably obtained. In addition, even if a residual image of the decolorizable black toner is left after the erasing process, the residual image becomes unrecognizable with respect to the non-erased toner images of the other three colors, as the influence of the residual black image is slight. Further, as shown in FIG. 11, the consumption of the decolorizable toner may be reduced.

Thus, according to this embodiment, when forming a full-color image with overlapped toner layers, the image density of a decolorizable black toner is set to be lower than those of other ordinary toners. For example, the image density of the decolorizable black toner is set within a range from 0.44 (the minimum density) to 0.6 in which an inking effect can be obtained, and preferably within a range from 0.44 to 0.5. In this range, the amount of the decolorizable black toner used for the printing can be reduced without degrading the quality of a full-color image. In addition, the decolorizable black toner is sufficiently heated during the erasing process so that a residual image is less likely to remain on the sheet. Further, as the decolorizable black toner image is directly in contact with the heat roller 52 (refer to FIG. 4) in the erasing process, the decolorizable black toner image can be sufficiently heated. Moreover, even if the decolorizable black toner image having a lowest brightness is formed at a position closest to the surface of a sheet, as the amount of the black toner can be reduced, a residual image, if left after the erasing process, is not recognizable.

Further, it is needless to say that the density of the black toner can be adjusted in the first embodiment in the same way as described in the second embodiment.

While certain embodiments have been described, these embodiments have been presented by way of example only, and are not intended to limit the scope of the invention. Indeed, the novel embodiments described herein may be embodied in a variety of other forms. Furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

a first image forming unit configured to form a first image to be transferred to a sheet with a first toner that is decolorizable and has a first brightness; and a second image forming unit configured to form a second image to be transferred to the sheet with a second toner that has a second brightness that is greater than the first brightness, wherein at least apart of the first image transferred to the sheet is formed above the second image transferred to the sheet.

2. The image forming apparatus according to claim 1, further comprising:

a third image forming unit configured to form a third image to be transferred to the sheet with a third toner that has a third brightness that is greater than the first brightness and less than the second brightness, wherein at least apart of the third image transferred to the sheet is formed above the second image transferred to the sheet, and at least a part of the first image transferred to the sheet is formed above the third image transferred to the sheet.

3. The image forming apparatus according to claim 1, wherein the first image has a first density, and the second image has a second density that is higher than the first density.

4. The image forming apparatus according to claim 3, wherein the first density is equal to or greater than 0.44 and equal to or less than 0.6.

5. The image forming apparatus according to claim 3, wherein the first density is equal to or greater than 0.44 and equal to or less than 0.5.

6. The image forming apparatus according to claim 1, further comprising:

a density setting unit configured to set a density of the first image to be formed on the transfer unit such that the density of the first image is lower than a density of the second image.

7. The image forming apparatus according to claim 1, wherein the first toner has a black color.

8. The image forming apparatus according to claim 1, further comprising:

a transfer unit on which the first image is formed by the first image forming unit and on which the second image is formed by the second image forming unit, and configured to convey the first and second images thereon to a transfer region at which the first and second images are transferred from the transfer unit to the sheet, wherein the first image forming unit is disposed upstream with respect to the second image forming unit along a sheet conveying direction.

9. A method for forming an image on a sheet, comprising:

forming a first image on a transfer unit with a first toner that is decolorizable and has a first brightness;

forming a second image on the transfer unit with a second toner that has a second brightness that is greater than the first brightness; and transferring the first and second images from the transfer unit to a sheet, such that at least a part of the first image transferred to the sheet is formed above the second image transferred to the sheet.

10. The method according to claim 9, further comprising:

forming a third image on the transfer unit with a third toner that has a third brightness that is greater than the first brightness and less than the second brightness; and transferring the third image together with the first and second images from the transfer unit to the sheet, such that at least a part of the third image transferred to the sheet is formed above the second image transferred to the sheet, and that at least a part of the first image transferred to the sheet is formed above the third image transferred to the sheet.

11. The method according to claim 9, wherein the first image has a first density, and the second image has a second density that is higher than the first density.

12. The method according to claim 9, further comprising:

setting a density of the first image to be formed on the transfer unit such that the density of the first image is lower than a density of the second image.

13. The method according to claim 9, wherein the first toner has a black color.

14. The method according to claim 9, wherein the first image is formed on the transfer unit before the second image is formed on the transfer unit.

15. An image forming apparatus, comprising:

an image forming unit configured to form, on a sheet, an image including a first image of a first color material that is decolorizable and has a first brightness and a second image of a second color material that has a second brightness that is greater than the first brightness, wherein at least a part of the first image on the sheet is formed above the second image on the sheet.

16. The image forming apparatus according to claim 15, wherein the image further includes a third image of a third color material that has a third brightness that is greater than the first brightness and less than the second brightness, and at least a part of the third image on the sheet is formed above the second image on the sheet, and at least a part of the first image on the sheet is formed above the third image on the sheet.

17. The image forming apparatus according to claim 15, wherein the first image has a first density, and the second image has a second density that is higher than the first density.

18. The image forming apparatus according to claim 17, wherein the first density is equal to or greater than 0.44 and equal to or less than 0.6.

19. The image forming apparatus according to claim 15, further comprising:

a density setting unit configured to set a density of the first image to be formed on the sheet such that the density of the first image is lower than a density of the second image.

20. The image forming apparatus according to claim 15, wherein the first color material has a black color.

* * * * *